US012643191B2

(12) United States Patent
Lu et al.

(10) Patent No.: US 12,643,191 B2
(45) Date of Patent: Jun. 2, 2026

(54) INTEGRATED MACHINING DEVICE FOR GRINDING AND POLISHING DIAMOND AND METHOD THEREOF

(71) Applicant: HUAQIAO UNIVERSITY, Quanzhou City (CN)

(72) Inventors: Jing Lu, Xiamen City (CN); Hailang Wen, Xiamen City (CN); Qiufa Luo, Xiamen City (CN); Chen Li, Xiamen City (CN); Tengfeng Ai, Xiamen City (CN)

(73) Assignee: HUAQIAO UNIVERSITY, Quangzhou City (CN)

( * ) Notice: Subject to any disclaimer, the term of this patent is extended or adjusted under 35 U.S.C. 154(b) by 340 days.

(21) Appl. No.: 18/217,001

(22) Filed: Jun. 30, 2023

(65) Prior Publication Data

US 2023/0339064 A1 Oct. 26, 2023

Related U.S. Application Data

(63) Continuation of application No. PCT/CN2021/099947, filed on Jun. 15, 2021.

(30) Foreign Application Priority Data

Dec. 30, 2020 (CN) ..... 202011609699.3

(51) Int. Cl.
*B24B 27/00* (2006.01)
*B24B 37/04* (2012.01)
*B24B 41/06* (2012.01)

(52) U.S. Cl.
CPC ..... *B24B 27/0076* (2013.01); *B24B 27/0069* (2013.01); *B24B 37/04* (2013.01); *B24B 41/06* (2013.01)

(58) Field of Classification Search
CPC . B24B 27/00; B24B 27/0076; B24B 27/0069; B24B 37/00; B24B 37/04;
(Continued)

(56) References Cited

U.S. PATENT DOCUMENTS

2005/0133277 A1* 6/2005 Dixon ..... B23C 5/1009 175/426

FOREIGN PATENT DOCUMENTS

CN 2127336 Y 2/1993
CN 102554760 A 7/2012
(Continued)

OTHER PUBLICATIONS

Corresponding International Patent Application No. PCT/CN2021/099947, International Search Report, mailing date Oct. 8, 2021.
(Continued)

*Primary Examiner* — C. A. Rivera
(74) *Attorney, Agent, or Firm* — COOPER LEGAL GROUP LLC

(57) ABSTRACT

An integrated device for grinding and polishing a diamond and a method thereof are provided. The integrated device for grinding and polishing the diamond comprises a base device and a grinding and polishing device, the base device comprises a base configured rotate around a vertical direction, the base comprises a fixture configured to clamp the diamond, the grinding and polishing device comprises a shaft disposed along the vertical direction, the outer polishing wheel surrounds the inner grinding wheel, the shaft drives the inner grinding wheel and the outer polishing wheel to rotate together, an upper and lower position relationship between the inner grinding wheel and the outer polishing wheel along the vertical direction is configured to be adjusted, and the diamond on the fixture is ground and
(Continued)

polished by rotations of the inner grinding wheel and the outer polishing wheel, feeding, and a rotation of the base.

9 Claims, 3 Drawing Sheets

(58) Field of Classification Search
CPC ..... B24B 37/07; B24B 41/02; B24B 41/06; B24D 18/00; B24D 18/0072
See application file for complete search history.

(56) References Cited

FOREIGN PATENT DOCUMENTS

| | | | | | |
|---|---|---|---|---|---|
| CN | 104972410 | A | | 10/2015 | |
| CN | 205651216 | U | | 10/2016 | |
| CN | 112676999 | A | | 4/2021 | |
| DE | 102009025116 | A1 | | 12/2010 | |
| JP | H07299720 | A | * | 11/1995 | |
| JP | 2002176018 | A | * | 6/2002 | |
| JP | 2004017165 | A | * | 1/2004 | |
| JP | 2014042950 | A | * | 3/2014 | ..... G08B 21/06 |

OTHER PUBLICATIONS

Corresponding International Patent Application No. PCT/CN2021/099947, Written Opinion, mailing date Oct. 8, 2021.

* cited by examiner

INTEGRATED MACHINING DEVICE FOR GRINDING AND POLISHING DIAMOND AND METHOD THEREOF

RELATED APPLICATIONS

This application is a continuation of International patent application PCT/CN2021/099947, filed on Jun. 15, 2021, which claims priority to Chinese patent application 202011609699.3, filed on Dec. 30, 2020. International patent application PCT/CN2021/099947 and Chinese patent application 202011609699.3 are incorporated herein by reference.

FIELD OF THE DISCLOSURE

The present disclosure relates to the technical field of diamond machining, and in particular relates to an integrated machining device for grinding and polishing diamond and a method thereof.

BACKGROUND OF THE DISCLOSURE

Diamond is known as the hardest material in nature and belongs to a category of superhard materials. Surface machining of the diamond is difficult and inefficient due to superhard characteristics of the diamond.

Surface machining of the traditional single crystal diamond uses hard-contact mechanical polishing to machine a surface of the diamond using a high-speed metal rotary disk. This machining method has been widely used for machining of a surface of diamond crystal of jewelry with high polishing efficiency, while the deficiencies are as follows: first, a roughness of the surface of the diamond crystal after polishing can only reach about 100 nm, which cannot meet needs for diamonds in the semiconductor field; second, a large amount of heat is generated in the hard-contact mechanical polishing, resulting in a surface temperature of the diamond crystal and the high-speed metal rotary disk being too high and easily leading to graphitization of the diamond surface. A large amount of graphite and diamond scraps generated in the grinding will enter the high-speed metal rotary disk, easily causing obvious damage to the high-speed metal rotary disk. Therefore, a replacement frequency of a polishing disk is very high, and polishing effects are poor in repeatability. Moreover, costs of the surface machining of the traditional single crystal diamond is greatly increased.

Microwave plasma etching and chemical polishing are commonly used polishing methods in the field of the semiconductor materials. The microwave plasma etching needs a special expensive etching device and a further surface treatment after etching to form a non-destructive diamond crystal surface. Chemical components of a polishing solution used in the chemical polishing react with the surface of the diamond to reduce a surface roughness of the diamond. However, the chemical polishing causes the surface of the diamond to have poor flatness and poor parallelism prone to produce defects, such as corrosion pits.

At present, methods for grinding and polishing the diamond are two independent systems. A method for machining the diamond from a rough substrate to polishing is complex and time-consuming, and the methods for grinding and polishing the diamond require the diamond to be clamped twice, resulting in positioning errors in a processing of the machining.

BRIEF SUMMARY OF THE DISCLOSURE

The present disclosure provides an integrated machining device for grinding and polishing diamond and a method thereof to overcome the deficiencies of the device for grinding and polishing diamond in the background.

In order to solve the technical problems of the present disclosure, a first technical solution is as follows:

An integrated device for grinding and polishing a diamond comprises a frame, a base device, and a grinding and polishing device, the base device comprises a sliding base configured to feed along a lateral direction relative to the frame and a base configured to be rotatably connected to the sliding base around a vertical direction, the base comprises a fixture configured to clamp the diamond, the grinding and polishing device comprises a shaft disposed along the vertical direction, an inner grinding wheel and an outer polishing wheel are respectively sleeved on the shaft, the outer polishing wheel surrounds the inner grinding wheel, the shaft drives the inner grinding wheel and the outer polishing wheel to rotate together, an upper and lower position relationship between the inner grinding wheel and the outer polishing wheel along the vertical direction is configured to be adjusted, and the diamond on the fixture is ground and polished by rotations of the inner grinding wheel and the outer polishing wheel, feeding of the sliding base, and a rotation of the base.

In a preferred embodiment, the outer polishing wheel is fixedly disposed on the shaft, the inner grinding wheel is configured to slide upward and downward along the vertical direction relative to the shaft, the inner grinding wheel and the shaft rotate synchronously, and the inner grinding wheel slides upward and downward to enable the upper and lower position relationship between the inner grinding wheel and the outer polishing wheel to be adjusted.

In a preferred embodiment, an outer diameter of the inner grinding wheel is smaller than an inner diameter of the outer polishing wheel.

In a preferred embodiment, the inner grinding wheel comprises an inner wheel body and hard abrasives adhered to the inner wheel body by adhesives, the adhesives are at least one of ceramic, metal, resin, or rubber, the hard abrasives are at least one of diamonds, cubic boron nitride, boron carbide, silicon carbide, or aluminum oxide, and particle sizes of the hard abrasives are 0.5-60 μm.

In a preferred embodiment, the outer polishing wheel is made by a sol-gel method, the outer polishing wheel has hard abrasives, the hard abrasives are at least one of diamonds, cubic boron nitride, boron carbide, silicon carbide, or aluminum oxide, and particle size of the hard abrasives are 0.5-60 μm.

In a preferred embodiment, a center of an upper end surface of the base is recessed to define an installation groove, a vacuum pad is disposed in the installation groove, the fixture is disposed on the vacuum pad, and the fixture is stuck to the base by the vacuum pad.

In a preferred embodiment, an upper end surface of the fixture is recessed to define a placement groove, the diamond is disposed in the placement groove, and the diamond is stuck in the placement groove of the fixture by adhesives.

In a preferred embodiment, the fixture uses an inch-thick hard substrate as a substrate, the inch-thick hard substrate is a silicon carbide substrate, a sapphire substrate, a silicon substrate, or a ceramic substrate, and the adhesives are selected from one or more of yellow wax, AB adhesives, epoxy resin, ultraviolet (UV) adhesives, hot-melt adhesives, pressure sensitive adhesives, or latex.

In a preferred embodiment, the fixture comprises a body, two sliding blocks, and two adjusting members, a top wall of the body comprises a base wall and a protruding platform protruding from the base wall, the protruding platform comprises two positioning walls facing the base wall and vertically disposed, the base wall of the body is recessed to define two sliding grooves leading to a side wall of the body, the two sliding grooves are respectively disposed along the two positioning walls, tops of the two sliding blocks horizontally protrude to define two protruding portions, the two sliding blocks are respectively slidably connected to two sliding grooves, the two protruding portions are disposed on the base wall, the two protruding portions form two locking walls, the two locking walls of the two sliding blocks and the two positioning walls respectively face each other, the two adjusting members are respectively connected to the two sliding blocks and the body to adjust the two sliding blocks to slide along the two sliding grooves by the two adjusting members, and the diamond that is stuck to the base wall is clamped by the two locking walls and the two positioning walls.

In a preferred embodiment, the shaft rotates to drive the inner grinding wheel and the outer polishing wheel to rotate together.

In order to solve the technical problems of the present disclosure, a first technical solution is as follows:

A machining method using the integrated device for grinding and polishing, it comprises:

sticking the diamond to the fixture with adhesives, assembling the fixture to the base, adjusting the upper and lower position relationship of the inner grinding wheel to enable a bottom surface of the inner grinding wheel to be lower than a bottom surface of the outer polishing wheel, rotating the inner grinding wheel, rotating the base, and feeding the sliding base to grind the diamond, adjusting the upper and lower position relationship of the inner grinding wheel to enable the bottom surface of the inner grinding wheel to be higher than the bottom surface of the outer polishing wheel, and rotating the outer polishing wheel, rotating the base, and feeding the sliding base to polish the diamond.

Compared to the existing techniques, the present disclosure has the following advantages.

The grinding and the polishing are integrated into one process for machining the diamond, and the clamping is performed one time for the grinding and the polishing to avoid errors and improve a yield rate caused by multiple clampings. A surface roughness of a large single crystal diamond with an original surface greater than 300 nm can be machined to 0.2-0.4 nm. Scratch damage on the surface of the diamond is less, a surface quality is uniform, a time for the grinding and the polishing is short, and an efficiency is high.

The fixture is stuck to the base by the vacuum pad, clamping is simple and convenient, and an accuracy is high.

The diamond is disposed in the placement groove, and the diamond is stuck in the placement groove of the fixture by the adhesives. Clamping is convenient, and an accuracy is high. A problem that a single crystal diamond is difficult to be clamped and fixed due to a small size (e.g., a square sheet below 10 mm×10 mm) of the single crystal diamond is resolved.

The inner grinding wheel slides upward and downward to adjust the upper and lower position relationship between the inner grinding wheel and the outer polishing wheel, so that switching between the grinding and the polishing is convenient and fast, and machining with automatic grinding and polishing is achieved by cooperating with an automatic rotating grinding machine.

The inner grinding wheel grinds and the outer polishing wheel polishes, so that an efficiency is improved, and a surface quality is ensured.

The inner grinding wheel comprises the inner wheel body and the hard abrasives adhered to the inner wheel body by the adhesives. The adhesives are at least one of ceramic, metal, resin, or rubber, or the hard abrasives are at least one of diamond, cubic boron nitride, boron carbide, silicon carbide, or aluminum oxide. The particle sizes of the hard abrasives are 0.5-60 μm. A grinding efficiency is high, and a service life is long.

The outer polishing wheel is made by the sol-gel method. The outer polishing wheel comprises hard abrasives, and the hard abrasives are at least one of diamond, cubic boron nitride, boron carbide, silicon carbide, or aluminum oxide. The particle sizes of the hard abrasives are 0.5-60 μm. A grinding efficiency is high, and a service life is long.

The top wall of the body comprises the base wall and the protruding platform. The two sliding blocks are respectively slidably connected to two sliding grooves, tops of the two sliding blocks horizontally protrude to define protruding portions, the protruding portions are disposed on the base wall, and the protruding portions form locking walls. The diamond that is stuck to the base wall is clamped by two locking walls and two positioning walls. Therefore, a diamond with a small thickness can be tightly clamped, and diamonds with different sizes can be adopted to solve difficulties in clamping diamond substrates. The clamping is firm, stable, and reliable, assembly and disassembly is simple and convenient, and a machining efficiency is improved.

DETAILED DESCRIPTION OF THE EMBODIMENTS

The technical solution of the present disclosure will be further described below in combination with the accompanying embodiments and drawings.

Embodiment 1

Figure 1:
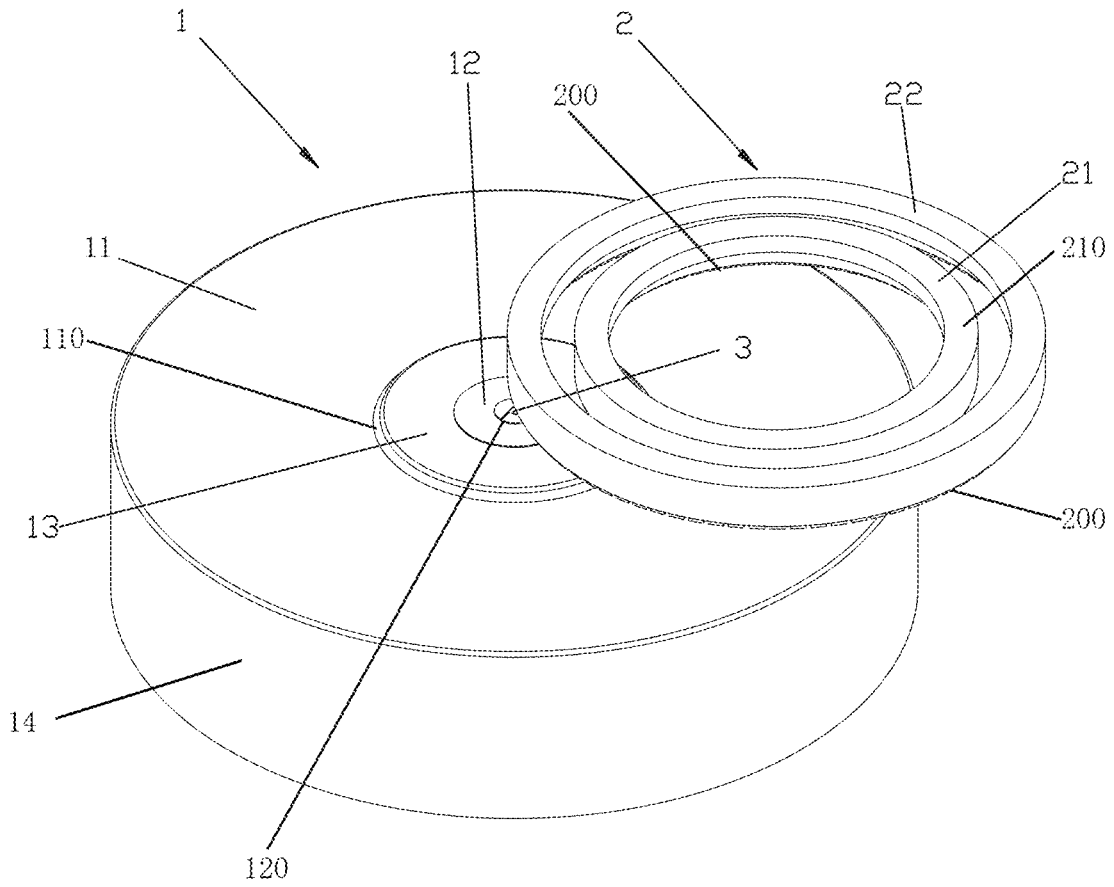
FIG. 1 illustrates a perspective view of a part of a machining device of Embodiment 1.
Figure 2:
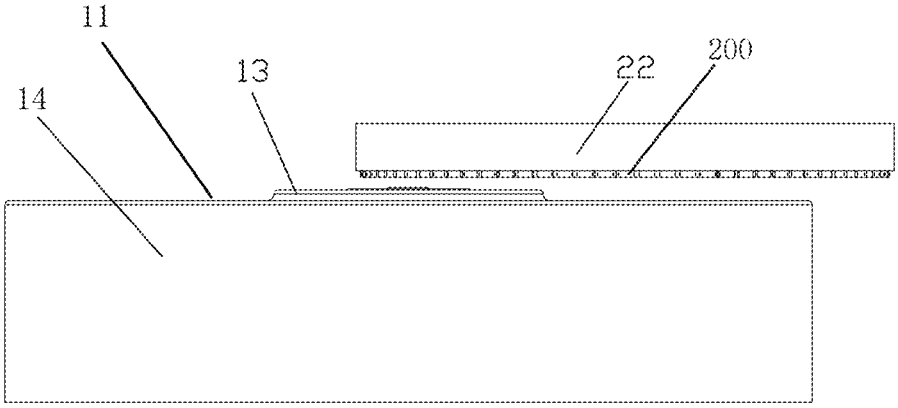
FIG. 2 illustrates a front view of the part of the machining device of Embodiment 1.
Figure 3:
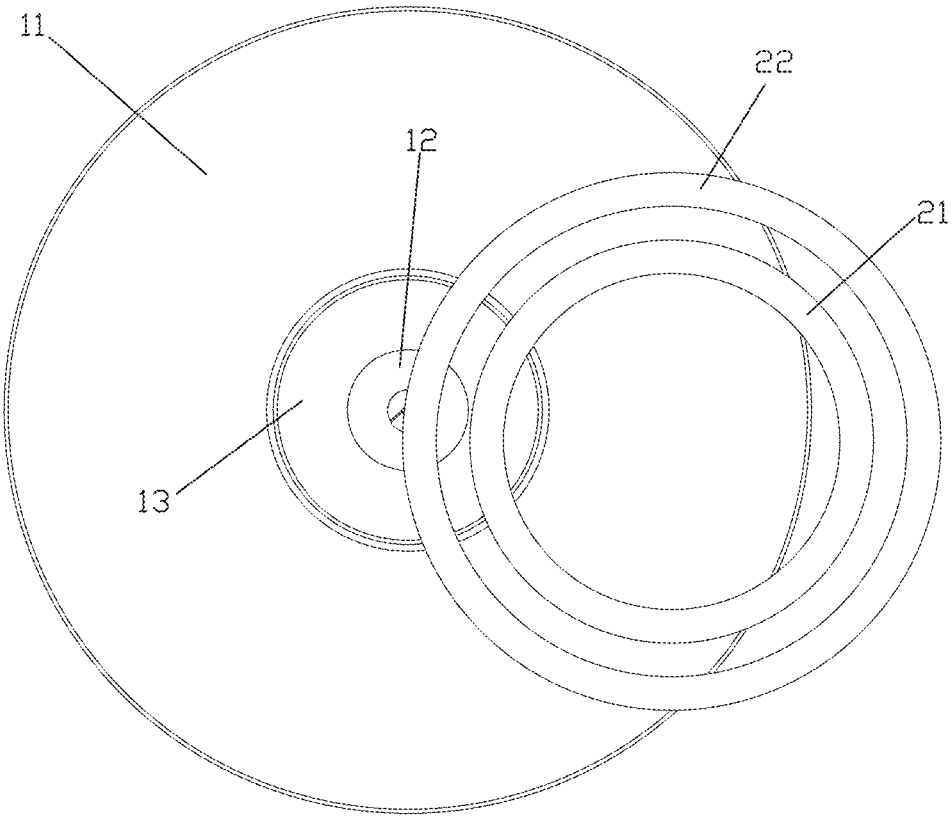
FIG. 3 illustrates a top view of the part of the machining device of Embodiment 1.

Referring to FIGS. 1-3, an integrated machining device for grinding and polishing diamond comprises a frame, a base device 1, and a grinding and polishing device 2. The base device 1 comprises a sliding base 14 configured to feed along a lateral direction relative to the frame and a base 11 configured to be rotatably connected to the sliding base 14 around a vertical direction. The base 11 comprises a fixture 12 configured to clamp a diamond 3 (e.g., a single crystal diamond). The grinding and polishing device 2 comprises a shaft disposed along the vertical direction, and the shaft is sleeved with an inner grinding wheel 21 and an outer polishing wheel 22. An outer diameter of the inner grinding wheel 21 is smaller than an inner diameter of the outer polishing wheel 22. The outer polishing wheel 22 surrounds the inner grinding wheel 21. The outer polishing wheel 22 is fixedly disposed on the shaft. The inner grinding wheel 21 is configured to slide upward and downward relative to the shaft along the vertical direction, and the inner grinding wheel 21 is connected to the shaft and rotates synchronously with the shaft. The inner grinding wheel 21 slides upward and downward to enable an upper and lower position relationship between the inner grinding wheel 21 and the outer polishing wheel 22 to be adjusted. When the shaft rotates, the shaft can drive the inner grinding wheel 21 and the outer polishing wheel 22 to rotate together. The diamond 3 on the fixture 12 is ground and polished by rotations of the inner grinding wheel 21 and the outer polishing wheel 22, feeding of the sliding base 14, and a rotation of the base 11. In a specific structure, a first motor is operatively connected to the sliding base 14 to drive the sliding base 14 to feed through a screw nut mechanism, a second motor is disposed on the sliding base 14 and is operatively connected to the base to drive the base to rotate, a third motor is operatively connected to the shaft to drive the shaft to rotate, the shaft comprises a fourth motor, and the fourth motor is operatively connected to the inner grinding wheel to drive the inner grinding wheel to slide.

The inner grinding wheel 21 comprises an inner wheel body 210 and hard abrasives 200 adhered to the inner wheel body 210 by adhesives. The adhesives are at least one of ceramic, metal, resin, or rubber. The hard abrasives 200 are at least one of diamonds, cubic boron nitride, boron carbide, silicon carbide, or aluminum oxide, and particle sizes of the hard abrasives 200 are 0.5-60 μm. The outer polishing wheel 22 is made by a sol-gel method. The outer polishing wheel 22 comprises hard abrasives 200. The hard abrasives 200 are at least one of the diamond, the cubic boron nitride, the boron carbide, the silicon carbide, or the aluminum oxide, and particle sizes of the hard abrasives 200 are 0.5-60 μm. For example, the outer polishing wheel 22 is a sol-gel (SG) polishing wheel, and the SG polishing wheel can reduce subsurface damage.

A center of an upper end surface of the base 11 is recessed to define an installation groove 110, and a vacuum pad 13 is disposed in the installation groove 110. The fixture 12 is disposed on the vacuum pad 13, and the fixture 12 is stuck to the base 11 by the vacuum pad 13. In a specific structure, an upper end surface of the fixture 12 is recessed to define a placement groove 120, the diamond 3 is disposed in the placement groove 120, and the diamond 3 is stuck in the placement groove 120 of the fixture 12 by adhesives. The fixture 12 uses an inch-level hard substrate as a substrate. The inch-level hard substrate is a silicon carbide substrate, a sapphire substrate, a silicon substrate, or a ceramic substrate. The adhesives are selected from one or more of yellow wax, AB adhesives, epoxy resin, ultraviolet (UV) adhesives, hot-melt adhesives, pressure sensitive adhesives, and latex. Furthermore, a length and a width of the placement groove 120 should be larger (e.g., slightly larger) than an actual size of the diamond 3 by 0.5-1.5 mm. A depth of the placement groove 120 is about ⅓-⅔ of a thickness of the diamond 3. A clearance between the diamond 3 and the placement groove 120 is filled with the adhesives, and a small amount of the adhesives can overflow from the clearance. A bottom center of the placement groove 120 is machined to form one or more through holes with diameters of 0.5-1.5 mm.

A machining method using the integrated machining device for grinding and polishing diamond comprises the following steps:

Trimming: trimming the inner grinding wheel 21 and the outer polishing wheel 22 using a trimming plate, and calibrating heights of the inner grinding wheel 21 and the outer polishing wheel 22 every time after trimming the inner grinding wheel 21 and the outer polishing wheel 22;

Diamond pretreatment: transferring diamond raw materials (for example, 7 mm×7 mm diamonds) into a beaker filled with alcohol, immersing, putting the beaker into an ultrasonic cleaning machine for ultrasonic cleaning (for example, 10 minutes) the diamond raw materials to obtain cleaned diamonds, measuring thicknesses of the cleaned diamonds, and machining the cleaned diamonds with a thickness difference within 10 μm in a same batch;

Clamping: binding the cleaned diamonds in the placement groove 120 of the fixture 12 by the adhesives, measuring and recording a height of each of the cleaned diamonds after the binding, controlling a maximum height difference between each of the cleaned diamonds to be within 5 μm, filling clearances between side surfaces of the cleaned diamond 3 and side surfaces of the placement groove 120 with the adhesives, and attaching the fixture 12 assembled with the cleaned diamonds on the vacuum pad after the cleaned diamonds are clamped to the fixture 12;

Grinding and polishing: adjusting the upper and lower position relationship between the inner grinding wheel 21 and the outer polishing wheel 22 to enable a bottom surface of the inner grinding wheel 21 to be lower than a bottom surface bottom of the outer polishing wheel 22. The inner grinding wheel 21 rotates, the base 11 rotates, and the sliding base 14 feeds to grind the diamonds 3. A rotary speed of the shaft is 1000 revolutions/second, a rotary speed of the base 11 is 301 revolutions/second, a feed speed of the sliding base 14 is 0.2 μm/second, and a feed length of the sliding base 14 is 100 μm;

Adjusting the upper and lower position relationship between the inner grinding wheel 21 and the outer polishing wheel 22 to enable the bottom surface of the inner grinding wheel 21 to be higher than the bottom surface of the outer polishing wheel 22, so that the inner grinding wheel 21 protrudes from the outer polishing wheel 22. The outer polishing wheel 22 rotates, the base 11 rotates, and the sliding base 14 feeds to polish the diamonds 3. The rotary speed of the shaft is 1500 revolutions/second, the rotary speed of the base 11 is 301 revolutions/second, the feed speed of the sliding base 14 is 0.1 μm/s, and the feed length of the sliding base 14 is 50 μm;

A model number of an automatic rotary surface grinding machine used for the grinding and the polishing is ACCRETECHHRG300. During a process of the grinding and the polishing, deionized water is used for cooling to avoid graphitization of the diamonds 3;

Taking out the diamonds 3: cleaning the diamonds 3 after the polishing together with the fixture 12 using a cleaning agent, and taking out the diamonds 3 that are cleaned;

Testing: measuring thicknesses of the diamonds 3 that are cleaned using a thickness gauge, and then measuring a surface roughness of the diamonds 3 that are cleaned using an atomic force microscope.

Embodiment 2

Figure 4:
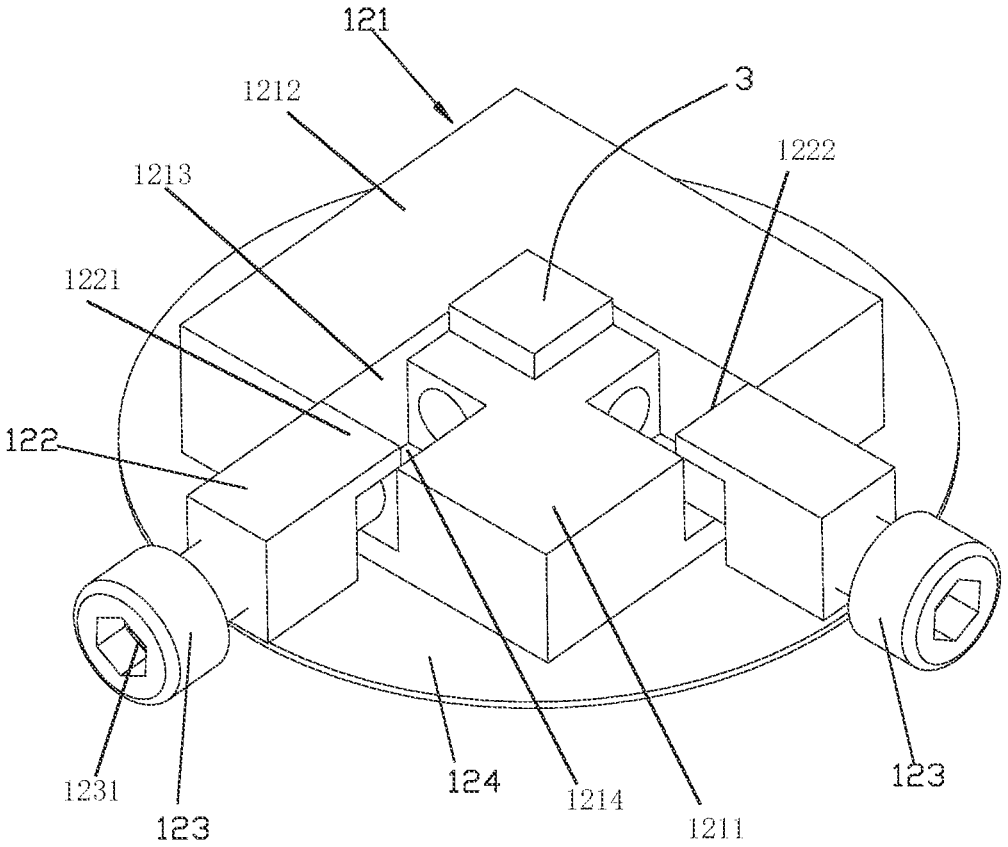
FIG. 4 illustrates a perspective view of a fixture of a machining device of Embodiment 2.

Referring to FIG. 4, the fixture 12 comprises a body 121, two sliding blocks 122, two adjusting members 123, and a base 124. A top wall of the body 121 comprises a base wall 1211 and a protruding platform 1212 protruding from the base wall 1211. The protruding platform 1212 comprises two positioning walls 1213 facing the base wall 1211 and vertically disposed. The two positioning walls 1213 are perpendicular to each other and cooperate to define in an L-shape. The base wall 1211 of the body 121 is recessed to define two sliding grooves 1214 leading to a side wall of the body 121. The two sliding grooves 1214 are respectively disposed along the two positioning walls 1213, and the two sliding grooves 1214 are perpendicular to each other. Tops of the two sliding blocks 122 horizontally protrude to define protruding portions 1221. The two sliding blocks 122 are respectively slidably connected to the two sliding grooves 1214, and the protruding portions 1221 are disposed on the base wall 1211. End surfaces of the protruding portions 1221 form locking walls 1222, and the locking walls 1222 of the two sliding blocks 122 and the two positioning walls 1213 respectively face each other. The two adjusting members 123 are respectively connected to the two sliding blocks 122 and the body 121 to adjust the two sliding blocks 122 to slide along the two sliding grooves 1214 by the two adjusting members 123, and the diamond 3 stuck to the base wall 1211 is clamped tightly by two locking walls 1222 and two positioning walls 1213. The protruding platform 1212 has an L-shaped structure, the base wall 1211 has a small rectangular structure, and the L-shaped structure and the small rectangular structure cooperate to form a large rectangular structure. The two positioning walls 1213 are respectively parallel to two adjacent sides of the large rectangular structure, and the two sliding grooves 1214 are respectively parallel to the two adjacent sides of the large rectangular structure. A groove wall of each of the two sliding grooves 1214 is aligned with a corresponding one of the two positioning wall 1213. Top walls of the two sliding blocks 122 are aligned with a top wall of the protruding platform 1212, and bottom walls of the protruding portions 1221 can be arranged to correspond with the base wall 1211 and slidably connected to the base wall 1211. The two adjusting members 123 comprise adjusting screws 1231, and the adjusting screws 1231 pass through the two sliding blocks 122 to be screwed to inner groove walls of the two sliding grooves 1214 of the body 121 to drive the two sliding blocks 122 to slide along the two sliding grooves 1214 by rotating the adjusting screws 1231. For example, the two sliding blocks 122 comprise through holes. The adjusting screws 1231 abut outer walls of the two sliding blocks 122, so that two locking walls 1222 abuts the diamond 3 by locking the adjusting screws 1231 tightly.

The aforementioned embodiments are merely some embodiments of the present disclosure, and the scope of the disclosure is not limited thereto. Thus, it is intended that the present disclosure cover any modifications and variations provided they are made without departing from the appended claims and the specification of the present disclosure.

What is claimed is:

1. A machining method using an integrated device for grinding and polishing a diamond, wherein:

the integrated device for grinding and polishing the diamond, comprises:

a base device, and a grinding and polishing device, wherein:

the base device comprises a sliding base configured to feed along a lateral direction and a base configured to be rotatably connected to the sliding base around a vertical direction, the base comprises a fixture configured to clamp the diamond, the grinding and polishing device comprises a shaft disposed along the vertical direction, an inner grinding wheel and an outer polishing wheel are respectively sleeved on the shaft, the outer polishing wheel surrounds the inner grinding wheel, the shaft drives the inner grinding wheel and the outer polishing wheel to rotate together, an upper and lower position relationship between the inner grinding wheel and the outer polishing wheel along the vertical direction is configured to be adjusted, the diamond on the fixture is ground and polished by rotations of the inner grinding wheel and the outer polishing wheel, feeding of the sliding base, and a rotation of the base, the fixture comprises a body, two sliding blocks, and two adjusting screws, a top wall of the body comprises a base wall and a protruding platform protruding from the base wall, the protruding platform comprises two positioning walls facing the base wall and vertically disposed, the base wall of the body is recessed to define two sliding grooves leading to a side wall of the body, the two sliding grooves are respectively disposed along the two positioning walls, tops of the two sliding blocks horizontally protrude to define two protruding portions, the two sliding blocks are respectively slidably connected to the two sliding grooves, the two protruding portions are disposed on the base wall, the two protruding portions form two locking walls, the two locking walls of the two sliding blocks and the two positioning walls respectively face each other, the two adjusting screws are respectively connected to the two sliding blocks and the body to adjust the two sliding blocks to slide along the two sliding grooves by the two adjusting screws, and the diamond that is stuck to the base wall is clamped by the two locking walls and the two positioning walls, and the machining method comprises:

sticking the diamond to the fixture with adhesives, assembling the fixture to the base, adjusting the upper and lower position relationship of the inner grinding wheel to enable a bottom surface of the inner grinding wheel to be lower than a bottom surface of the outer polishing wheel, rotating the inner grinding wheel, rotating the base, and feeding the sliding base to grind the diamond, adjusting the upper and lower position relationship of the inner grinding wheel to enable the bottom surface of the inner grinding wheel to be higher than the bottom surface of the outer polishing wheel, and rotating the outer polishing wheel, rotating the base, and feeding the sliding base to polish the diamond.

2. The machining method according to claim 1, wherein:

the outer polishing wheel is fixedly disposed on the shaft, the inner grinding wheel is configured to slide upward and downward along the vertical direction relative to the shaft, the inner grinding wheel and the shaft rotate synchronously, and the inner grinding wheel slides upward and downward to enable the upper and lower position relationship between the inner grinding wheel and the outer polishing wheel to be adjusted.

3. The machining method according to claim 1, wherein an outer diameter of the inner grinding wheel is smaller than an inner diameter of the outer polishing wheel.

4. The machining method according to claim 1, wherein:

the inner grinding wheel comprises an inner wheel body and hard abrasives adhered to the inner wheel body by the adhesives, the adhesives are at least one of ceramic, metal, resin, or rubber, the hard abrasives are at least one of diamonds, cubic boron nitride, boron carbide, silicon carbide, or aluminum oxide, and particle sizes of the hard abrasives are 0.5-60 μm.

5. The machining method according to claim 1, wherein:

the outer polishing wheel is made by a sol-gel method, the outer polishing wheel has hard abrasives, the hard abrasives are at least one of diamonds, cubic boron nitride, boron carbide, silicon carbide, or aluminum oxide, and particle sizes of the hard abrasives are 0.5-60 μm.

6. The machining method according to claim 1, wherein:

a center of an upper end surface of the base is recessed to define an installation groove, a vacuum pad is disposed in the installation groove, the fixture is disposed on the vacuum pad, and the fixture is stuck to the base by the vacuum pad.

7. The machining method according to claim 1, wherein:

an upper end surface of the fixture is recessed to define a placement groove, the diamond is disposed in the placement groove, and the diamond is stuck in the placement groove of the fixture by the adhesives.

8. The machining method according to claim 7, wherein:

the fixture uses an inch-thick hard substrate as a substrate, the inch-thick hard substrate is a silicon carbide substrate, a sapphire substrate, a silicon substrate, or a ceramic substrate, and the adhesives are selected from one or more of yellow wax, AB adhesives, epoxy resin, ultraviolet (UV) adhesives, hot-melt adhesives, pressure sensitive adhesives, or latex.

9. The machining method according to claim 1, wherein the shaft rotates to drive the inner grinding wheel and the outer polishing wheel to rotate together.

* * * * *